US010077139B2

(12) United States Patent
Coleman

(10) Patent No.: US 10,077,139 B2
(45) Date of Patent: Sep. 18, 2018

(54) SAMPLING BAG AND FUNNEL FOR COLLECTION OF SOILS, MUDS, OR OTHER SOLIDS OR LIQUIDS FOR SUBSEQUENT ANALYSIS OF HEADSPACE GASES AND OTHER CONTENT

(75) Inventor: Todd Coleman, Fairmount, IL (US)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 926 days.

(21) Appl. No.: 13/373,866

(22) Filed: Dec. 2, 2011

(65) Prior Publication Data

US 2013/0139474 A1 Jun. 6, 2013

Related U.S. Application Data

(60) Provisional application No. 61/217,944, filed on Jun. 5, 2009.

(51) Int. Cl.

| | |
|---|---|
| ***B65D 33/16*** | (2006.01) |
| ***B65D 33/00*** | (2006.01) |
| ***B65D 33/25*** | (2006.01) |
| ***B65D 30/08*** | (2006.01) |

(52) U.S. Cl.
CPC ..... *B65D 33/2508* (2013.01); *B65D 31/04* (2013.01); *B65D 2205/02* (2013.01)

(58) Field of Classification Search
CPC .... B65D 81/3881; B65D 31/04; B65D 31/12; B65D 31/14
USPC ..... 383/63, 54, 61.1, 61.2, 68, 94
See application file for complete search history.

(56) References Cited

U.S. PATENT DOCUMENTS

| | | | | |
|---|---|---|---|---|
| 3,471,871 | A * | 10/1969 | Nociti et al. | 4/484 |
| 3,746,215 | A * | 7/1973 | Ausnit | B65D 33/00 222/92 |
| 3,924,843 | A * | 12/1975 | Hirmann | 269/20 |
| 5,354,132 | A * | 10/1994 | Young et al. | 383/49 |
| 5,368,583 | A * | 11/1994 | Fleury | 604/318 |
| 6,116,780 | A * | 9/2000 | Young et al. | 383/44 |
| 6,527,444 | B1 * | 3/2003 | Buchman | 383/36 |
| 7,503,696 | B2 * | 3/2009 | Ha et al. | 383/69 |
| 7,510,328 | B2 * | 3/2009 | Schneider et al. | 383/204 |
| 7,748,200 | B2 * | 7/2010 | Buchman | 53/412 |
| 8,104,960 | B2 * | 1/2012 | Gill et al. | 383/36 |
| 2002/0094140 | A1 * | 7/2002 | Gill | A45F 3/20 383/68 |
| 2003/0231808 | A1 * | 12/2003 | Machacek et al. | 383/36 |
| 2005/0244083 | A1 * | 11/2005 | McMahon et al. | 383/63 |
| 2008/0292221 | A1 * | 11/2008 | Song | 383/61.2 |

* cited by examiner

*Primary Examiner* — Derek Battisti
(74) *Attorney, Agent, or Firm* — Patterson + Sheridan, LLP

(57) ABSTRACT

A collapsible bag or pouch for collecting samples of soil, mud, liquid and gases, having an internal mechanical seal and a heat sealable area near the opening that is protected during sample loading, preferably by a funnel detachable from the pouch. After loading and prior to heat sealing the pouch is secured from the outside by mechanical interlocking seal. The bag also has an air-tight port for sampling the gaseous headspace after the bag is sealed.

26 Claims, 3 Drawing Sheets

SAMPLING BAG AND FUNNEL FOR COLLECTION OF SOILS, MUDS, OR OTHER SOLIDS OR LIQUIDS FOR SUBSEQUENT ANALYSIS OF HEADSPACE GASES AND OTHER CONTENT

CROSS REFERENCE TO RELATED APPLICATIONS

This application claims the benefit of U.S. Provisional Application No. 61/217,944, filed 5 Jun. 2009, and is also the United States national stage application of PCT/US2010/001626 filed 5 Jun. 2010.

BACKGROUND

Historically, isotope analysis originated as a major tool for the field of geochemistry. However, as mass spectrometers and other equipment for taking isotopic measurements improve and advance, so does the utility of isotopic data in other areas. These have come to include oil and gas exploration, and gas identification and differentiation. In addition, isotope data has also become a useful tool in other fields, such as ecology, forensics, food adulteration, and others where isotope data can often provide a means of differentiating two otherwise chemically indistinguishable or undifferentiated substances.

As our world's energy supplies diminish, increasing attention is being given to recovering sources of oil and gas that were previously considered uneconomical and/or unconventional. These sources may be identified through "geochemical prospecting" of surface soils. A bag for containing a sample of soil and its associated gases, without altering its isotopic "signature" would be extremely valuable in helping to identify these sources. However, isotopic differences can arise in a sample during storage. Accordingly, it would be beneficial to control for mechanisms that might alter the isotopic signature of a sample substance. Geological sampling often requires specialized sampling containers and equipment, as described in various of the following published US applications: 20100083771 (Gas sampling apparatus); 20090260416 (Low dead-volume core-degassing apparatus); 20080282814 (Gas sampling apparatus); 20070056394 (Pressurized gas sampling container); 20040123679 (Gas sampling apparatus); the disclosures of which are incorporated herein by reference. Such devices can be used to contain a substance without altering or "fractionating" the sample's isotopic signature.

Traditional means of collecting soil samples utilize jars or other rigid containers which are quite bulky and relatively expensive to ship, especially to remote regions of the world where such prospecting often occurs. A rigid container (such as a jar) is always contaminated and/or its contents "diluted" by the atmospheric gases that occupy the container, and which constitute the headspace after the sample is introduced and the container sealed. This gaseous contamination (including atmospherically-borne contaminants) makes subsequent isotopic analysis difficult if not impossible. Additionally, techniques have been developed for sourcing groundwater from core samples using stable isotope analysis. In order to use such techniques, however, it is essential that samples be stored in such a way that prevents isotopic fractionation of the water vapor inside (i.e., no leakage on a molecular level).

SUMMARY OF THE INVENTION

In light of the foregoing, this invention provides a sample collection pouch having a sample collection bag in the form of a pouch having an opening to an interior portion and a closed end, the pouch is comprised of opposing facing films sealed along opposing edges, a portion of the film defining the interior portion and adjacent said opening comprising a heat sealable material, corresponding protrusions formed in said facing films to create a closure for sealing the bag, a self-sealing port disposed in one of said films between said closure and said closed end, and a removable funnel disposed in and extending from said opening to and beyond said closure.

More generally, this invention provides a collapsible bag or pouch for sample collecting having an internal mechanical seal and a heat sealable area near the opening that is protected during sample loading, preferably by a funnel detachable from the pouch. After loading and prior to heat sealing the pouch is secured from the outside by mechanical interlocking seal. The bag also has an air-tight port for sampling the gaseous headspace after the bag is sealed.

The invention also provides a clip for sealing the pouch, comprising a channel formed of a relatively rigid but flexible material, a softer, compressible material within the channel mostly surrounding a rigid rod inserted into and removable from the channel.

In use, the portion of the pouch adjacent the opening is heat sealable and is shielded from contamination by the funnel, which is removed after the sample is introduced. Thereafter, the closure is sealed, the clip is then secured between the closure and the opening, and one or more heat seals are formed from the facing films of the pouch between the clip and the opening to produce a sample contained within a pouch having two mechanical seals and at least one heat seal.

This invention advantageously provides a compressible container, a bag or pouch, that addresses the need to reduce dilution of a sample substrate that outgases and/or desorbs gases over time. The ability to squeeze out excess air prior to sealing means the headspace will have in a higher concentration of gases targeted for analysis (e.g., isotopic analysis). This is important because some testing (such as isotopic testing) requires a sufficient concentration of the gaseous compound to provide data other than its mere presence. The compressible wall of the container allows removal of air from the air head space, which reduces both air contamination and dilution of the sample gases.

DETAILED DESCRIPTION OF PARTICULAR EMBODIMENTS

Figure 1:
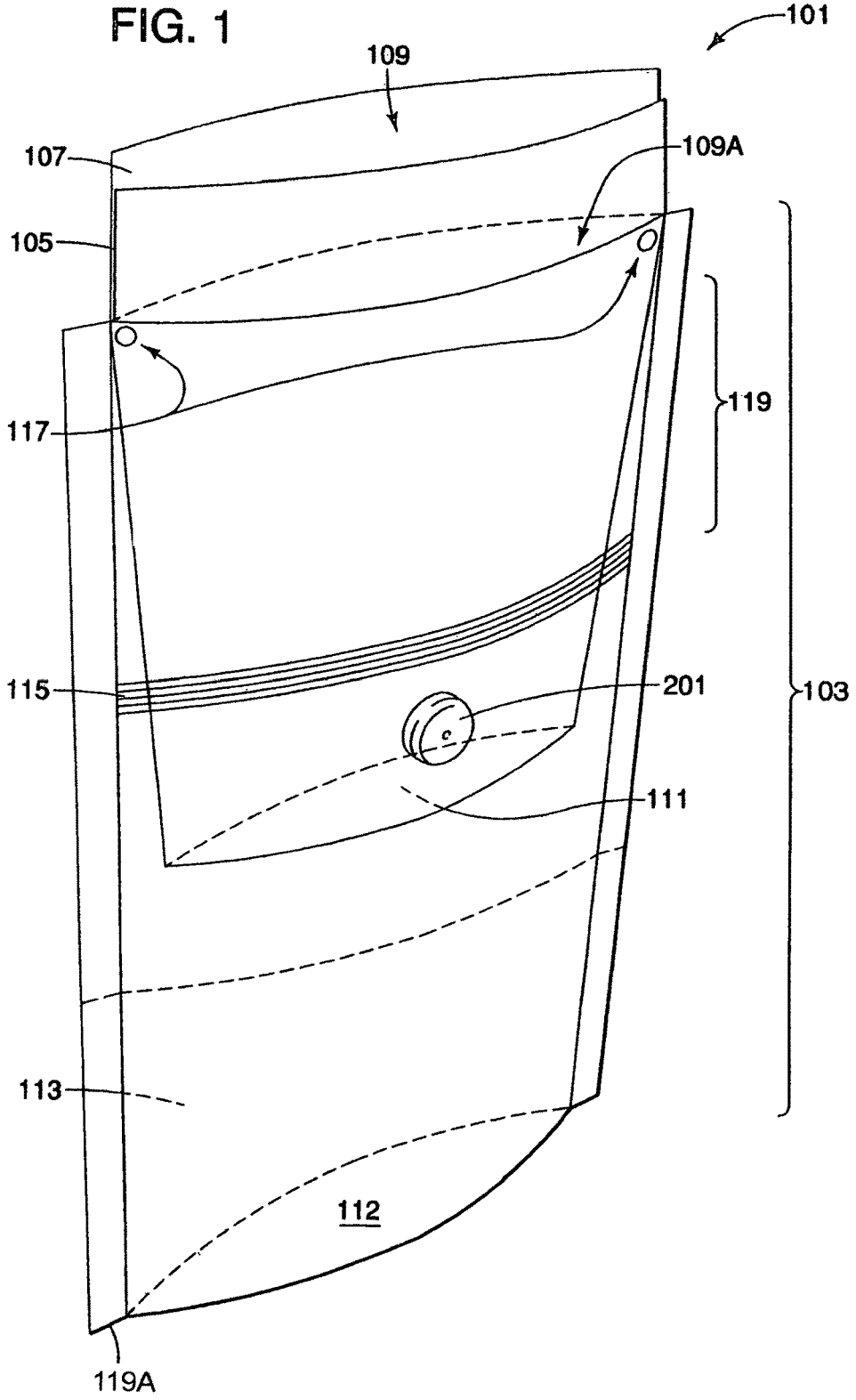
FIG. 1 is a perspective view of a sample collection pouch according to the invention.

As shown in FIG. 1, the invention preferably includes a wide-mouth, pleated sample bag 101 produced of a material that will not alter the isotopic "signature" of the material which it contains. The bag is generally made of plastic and/or foil films; transparent or translucent plastic is most preferred; metallized, mostly transparent films are acceptable if non-reactive with the sample contents. Different film materials can also be utilized to create customized pouches specifically designed or chosen to contain the particular "species" of interest.

The pouch or gas bag portion 103 has an open end in which a funnel 105 is positioned. The funnel includes a wider mouth portion 107 defining an opening 109 that is essentially coextensive with the opening of the pouch, and continues to a narrower end opening 111 which is disposed within the pouch. The base 112 of the pouch defines the closed end, and the adjacent portion of the pouch defines an interior portion 113 in which a sample is retained.

Between the sample-retaining portion 113 of the interior and the opening of the pouch 109A is a mechanical seal closure 115. Preferably, this closure is a profile extrusion in the opposing films to provide an interlocking closure, such as described in U.S. Pat. No. 4,561,109 and Re. 28,969 (e.g., a re-sealable zip type closure), the disclosures of which are incorporated herein by reference.

The funnel is preferably tacked to the pouch (e.g., glued, heat-sealed, or tack-welded) at small areas, 117, adjacent the opposing seams where the pouch films meet, the areas being sufficient to keep the funnel in place during transport, but small enough to allow the funnel to be torn out without significant (and preferably without any) damage to the pouch. The funnel then can be tacked to the pouch only at the portion near the opening. By virtue of this structure, the user may tear the funnel away from the bag.

The pouch is preferably made from opposing films. The films are preferably multilayer films to provide both strength and durability to the pouch and to protect the sample from isotopic signature changes. In addition, the use of films allows the pouch to be collapsed and the air forced out prior to sealing, in contrast to the rigid containers used presently. Still further, the portion of the films defining the interior space are preferably upper heat-seable in the area between the closure 115 and the bag opening 109A. As described, the funnel spans the same extent, thereby protecting preferably both the heat-sealable material 119 and the mechanical closure 115 and the port 201 from contamination by sample materials, which are directed by the funnel to the sample retaining portion (113) of the pouch.

The portions of the films defining the heat-sealable area 119 and 119A preferably comprise a polyolefin that is heat sealable. Commercial and home-use heat-sealing systems for storing food are well-known. In this invention, polyethylene (PE), especially low density, is preferred. Depending on the sample material collected, one or more layers may be treated, and/or layers may be provided, to secure the chemical signature of the sample contents remains unchanged. For example, an ethylene vinyl alcohol (EVOH) copolymer can be used as the heat sealable material to reduce oxygen penetration through the bag to the sample. For samples containing carbon dioxide, a higher density (HDPE) and/or a more crystalline polyolefin, and/or a metal foil, can be used to provide a hermetically sealed interior. The outer layer is preferably relatively tough, such as a polyamide (e.g., a nylon), a polyethylene terephthalate (PET), or polypropylene, or combinations thereof. Various ways of making multilayer film materials are well-known, including co-extrusion, lamination, and combinations thereof. Exemplary multilayer films include a two layer film (outside to inside) with nylon and EVOH/PE, and a five layer film with PET, HDPE, foil, regular density PE, and low density PE. Such films are commercial available as, for example, a 5 mil clear biaxially oriented nylon and EVOH/LLDPE laminated barrier film, and a 4 mil white laminated PET/PE/foil/PE/LLDPE film. The collected samples will produce gasses, termed "off gasses." The films are substantially impermeable to off gasses and thus the gasses are retained. The films are also substantially impermeable to ambient atmosphere and gasses generally existing in the environment to prevent dilution of off gasses within the bag. Further more the films are non-reactive with the gathered sample and the sample off gases to preserve the isotopic fractions of the off gasses.

Figure 2A:
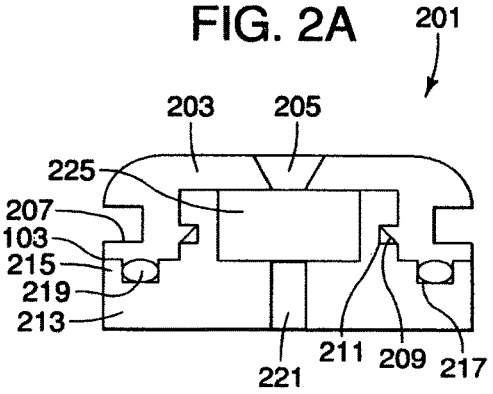
FIG. 2A is a cross-sectional view of the self-sealing port.
Figure 2B:
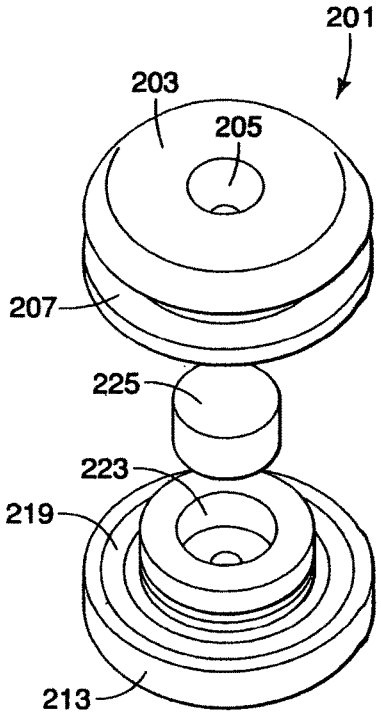
FIG. 2B is a perspective view of the self sealing port.

Disposed in one of the films is a self-sealing port 201, which is shown in more detail in FIGS. 2A and 2B. The port is preferably designed to be snapped in place over the film. The port has an upper cap 203 that will be on the outside of the pouch and, as shown, preferably has a tapered bore 205 and a depending side wall having exteriorly a circumferential foot 207, and interiorly a rib 209 defining an annulus. The rib engages a circumferential recess 211 formed in the bottom portion 213 of the port when the top and bottom snap together (i.e., the rib of the cap snaps into the recess of the bottom).

The side wall of the pouch 103A is disposed between the cap and bottom portion when the two are snapped together. The bottom also has a flange 215 extending about the perimeter which forms a surface on which the foot of the cap lies flush, and for added sealing includes a groove 217 in which is disposed a seal (e.g., an O-ring or synthetic washer) 219 secured between the cap foot and the flange. Axially, the bottom has a bore 221 that aligns with the tapered hole in the cap and opens into a center cavity 223 in the bottom portion. The cavity accepts a penetrable, self-sealing plug or septum 225 that blocks the bore and is positioned between the tapered hole in the cap and the bore. When assembled, a hypodermic needle can be inserted through the port (the first insertion thus penetrating the film) to remove material for analysis without compromising the chemical signature of the sample contents, or to add material (e.g., a liquid or gaseous reagent, or an inert gas or liquid). As shown, the upper or outermost portion of the cap preferably is separated from the foot by a groove to provide improved tactile sensation while grasping the cap. This can be an important consideration for avoiding puncturing the opposing film of the pouch when the plug is penetrated by the hypodermic needle. The groove also provides a means by which the pouch can be suspended and the head space sampled through the port.

In field use, for example, a hand spade or garden trowel is used to collect soil and then inserted through the funnel to place a sample of the material collected into the closed end portion of the sample container. Preferably, the outside of the pouch in the area in which the sample is retained (113) includes printed indicia with desired information such as, for example, a fill line, instructions for use, a form for indicating sample information (e.g., date, location, sample identification (such as a unique sample number or name), location from which the sample was taken, by whom the sample was taken, sampling conditions), or other notes or comments. After the sample is introduced, the bag is held vertically, the funnel, is removed, the bag compressed to remove the head space air and the re-sealable zip closure is secured, to retain the sample in the bag during the remaining manipulation.

Figure 3A:
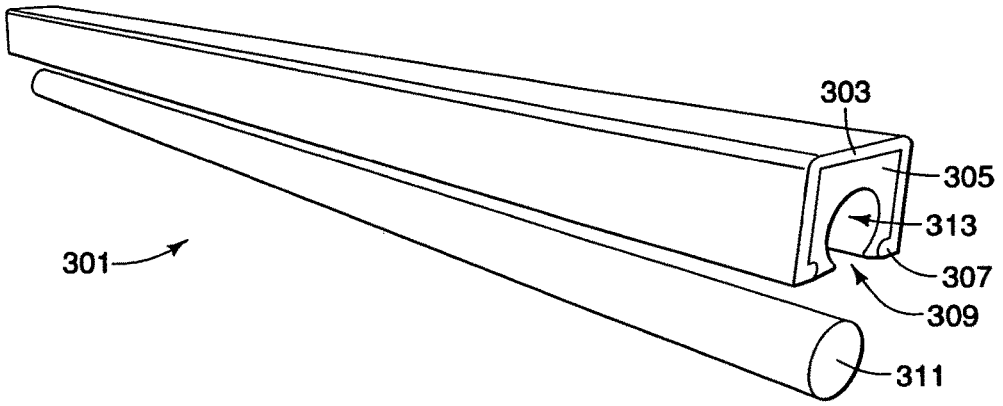
FIG. 3A is a perspective view of the clip components, shown partially exploded.
Figure 3B:
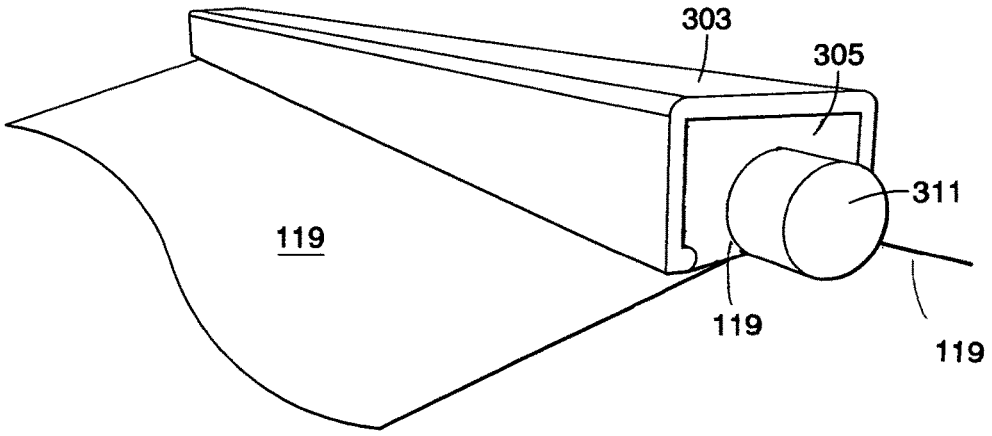
FIG. 3 B is a perspective view of the clip sealed onto the pouch.

It is preferred then to place a clip onto the bag because the closure does not form a gas tight seal, so leakage or reaction with incoming gas would fractionate or otherwise change the sample. The clip is secured onto the outside of the pouch. A preferred clip 301 is shown in FIGS. 3A and 3B as having a channel 303 in which is positioned a filling 305. The channel includes opposing cantilevers 307 to define an opening 309 of the channel. The channel material is preferably plastic that is relatively rigid, such as polyvinyl chloride, and also flexible. The filling is a soft material, preferably plastic, such as a vinylidene polymer, and may be highly elasticized. The clip also includes a rigid rod 311 which is inserted into the channel and retained by a combination of a close fit with the filling and the rigidity of the opposing cantilever support walls; the walls allow sufficient expansion for the rod to fit into a bore 313 defined by the filling and then reform the bore around the rod. The rod can be metal or plastic, or even ceramic, so long as it is durable in the field and during transport, and acts cooperatively with the filled channel to produce a seal. Preferably, the channel and filling are co-extruded. As shown in FIG. 3B, the upper heat-sealable portion of the pouch 119 is secured by the clip.

FIGS. 3A and 3B illustrates the process of clamping the pouch material 119. The pouch walls 119 are laid over the rigid rod 311. Rod 311 is then inserted, along its length into bore 313 along the bore's length. In FIG. 3B, the rod 311 is seen resting within bore 313. Pouch walls 119 extend to rod 311, then up and between rod 311 and filling 305 then down and out of bore 313.

The clip is capable of creating a vacuum tight seal. By virtue of the difference in rigidity of the two parts of the clip and the conformable nature of the soft inner portion, soft inner section of the clip conforms to irregularities in the films and can 'surround' these inconsistencies, providing consistent pressure along the length of the clip, and therefore providing a reliable means of sealing gases inside the pouch. Without these properties, the pressure on the inner rod tends to be inconsistent and incapable of providing a vacuum tight seal.

Figure 4:
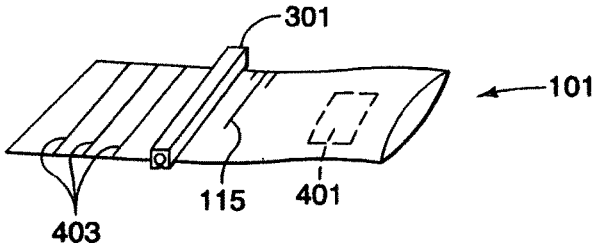
FIG. 4 is a perspective view of a sealed sample collection pouch with sample.

As noted, the closure is capable of being opened. Accordingly, it is preferable to heat-seal the sample pouch, and multiple seals are more preferred. As noted above, the funnel protects the heat-sealable material during introduction of the sample. After the funnel is removed, a commercially-available heat sealing machine can be used to add additional, permanent seals. It may be impractical, or impossible, to have such a device at the point of sampling, or even on location. Accordingly, the aforementioned clip is used to secure the pouch until the pouch can be heat-sealed. As shown in FIG. 4, a fully sealed pouch 101 containing a sample 401 is secured by the closure 115, the clip 301, and one or more heat seals 403. After heat sealing, the clip may be removed.

The foregoing description is meant to be illustrative and not limiting. Various changes, modifications, and additions may become apparent to the skilled artisan upon a perusal of this specification, and such are meant to be within the scope and spirit of the invention as defined by the claims.

What is claimed is:

1. A sample collection bag, comprising:

a. a pouch having an opening to an interior portion and a closed end, the pouch comprised of opposing facing films sealed along opposing edges, a portion of the films defining the interior portion and adjacent the opening comprising a heat sealable material for sealing the opening of the pouch, corresponding engageable protrusions formed in the facing films to create a closure for sealing the bag and disposed between the heat sealable material and the closed end;

b. a self-sealing port disposed in one of the films between the closure and the closed end; and c. a detachable funnel disposed in the opening and extending past the closure, the heat sealable material, and the self-sealing port, wherein the detachable funnel is attached to the pouch at a location above the closure.

2. The bag of claim 1, wherein the films defining the interior portion comprise heat sealable polyethylene.

3. The bag of claim 1, wherein the films are multilayer films.

4. The bag of claim 3, wherein the films comprise a first polyolefin layer and one side thereof, one or more layers selected from the group consisting of foils, a second polyolefin, a polyamide, a polyalkylene terephthalate, compatible combinations thereof, and compatible mixtures thereof.

5. The bag of claim 4, wherein the first polyolefin comprises a mixture of polyethylene and ethylene vinyl alcohol.

6. The bag of claim 3, wherein the films are substantially impermeable to sample off gasses.

7. The bag of claim 3, wherein the films are substantially impermeable to ambient air and gases.

8. The bag of claim 3, wherein the films are non-reactive with the sample and sample off gasses.

9. The bag of claim 1, further comprising at least one heat seal between the facing films disposed between the closure and the opening.

10. The bag of claim 1, further comprising indicia printed thereon.

11. The bag of claim 1, wherein the detachable funnel includes a first opening and a second opening smaller than the first opening, the second opening disposed in the pouch.

12. The bag of claim 1, wherein the detachable funnel is glued to the pouch.

13. The bag of claim 1, wherein the detachable funnel is heat-sealed to the pouch.

14. The bag of claim 1, wherein the detachable funnel is tack-welded to the pouch.

15. The bag of claim 1, wherein the corresponding engageable protrusions are configured to mate with each other, thereby sealing the bag, and wherein the detachable funnel is detached when the corresponding engageable protrusions are mated with each other.

16. The bag of claim 1, wherein the detachable funnel is detachable after a sample is collected in the bag.

17. The bag of claim 1, wherein the detachable funnel is attached to the interior portion of the pouch between the corresponding engageable protrusions and the opening.

18. The bag of claim 1, wherein the self-sealing port comprises an upper cap engageable to a bottom portion.

19. A kit, comprising: the bag of claim 1; and a clip, comprising: a channel of a relatively rigid material filled with a relatively softer and more elastic filling material compressively holding within the channel a rigid rod having a length, wherein the channel includes a bore and a longitudinal opening extending along the channel, wherein the bore is configured to receive the rigid rod via insertion through the longitudinal opening.

20. The kit of claim 19, wherein the clip is disposed on a portion of the pouch between the closure and the opening.

21. The kit of claim 20, further comprising at least one heat seal between the facing films disposed between the clip and the opening.

22. The kit of claim 19, wherein the filling material provides a seal against a length of the rigid rod.

23. The kit of claim 22, wherein the filling material has a longitudinal opening that is narrower than the longitudinal opening of the channel.

24. An assembly for storing and sealing a sample collection, comprising: a pouch with an open end, the pouch having a sample retaining portion, a sealable portion for sealing the open end, and a closure member disposed between the sample retaining portion and the sealable portion, wherein the closure member is configured to isolate the sample retaining portion from the sealable portion; a self-sealing port; a detachable funnel disposed in the open end of the pouch, the detachable funnel having a first opening below the closure member and the self-sealing port, and a second opening larger than the first opening above the closure member, wherein the detachable funnel is attached to the pouch at a location above the closure; and a clip configured to create a seal across the sealable portion.

25. The assembly of claim 24, wherein the self-sealing port is disposed in the sample retaining portion of the pouch.

26. The assembly of claim 24, wherein the clip includes:

a channel with an opening along a longitudinal axis thereof for receiving a length of a rigid rod, and a filling material disposed between the channel and the length of the rigid rod, the filling material providing a seal against the length of the rigid rod.

* * * * *